US005431283A

United States Patent [19]

Weinstein et al.

[11] Patent Number: 5,431,283

[45] Date of Patent: Jul. 11, 1995

[54] BLISTER PACK OPENER-EJECTOR

[75] Inventors: Jack Weinstein, Boro of Lakehurst; John E. Harrold, Boro of Bloomsbury, both of N.J.

[73] Assignee: Primary Delivery Systems, Inc., Easton, Pa.

[21] Appl. No.: 222,403

[22] Filed: Apr. 1, 1994

Related U.S. Application Data

[63] Continuation-in-part of Ser. No. 47,994, Apr. 19, 1993, which is a continuation-in-part of Ser. No. 6,528, Jan. 21, 1993, Pat. No. 5,356,010.

[51] Int. Cl.[6] ..... B65D 83/04

[52] U.S. Cl. ..... 206/531; 206/469; 30/358; 30/125

[58] Field of Search ..... 53/492, 381.2; 206/531 I, 532, 539, 469, 528, 535; 220/284; 229/204, 229, 103; 30/358, 363, 125, 124; 83/167; 225/103, 93

[56] References Cited

U.S. PATENT DOCUMENTS

| | | | |
|---|---|---|---|
| 2,386,416 | 10/1945 | Wilhelm . | |
| 2,473,492 | 6/1949 | Shina . | |
| 3,721,382 | 3/1973 | Cavanagh et al. . | |
| 3,993,190 | 11/1976 | Schmidgall . | |
| 4,015,717 | 4/1977 | Richardson et al. . | |
| 4,126,263 | 11/1978 | Martensson . | |
| 4,159,568 | 7/1979 | Berner . | |
| 4,179,806 | 12/1979 | Leiptz . | |
| 4,384,649 | 5/1983 | Brodsky . | |
| 4,457,427 | 7/1984 | Caffiero . | |
| 4,694,996 | 9/1987 | Siegel | 53/492 |
| 4,706,875 | 11/1987 | Blackman . | |
| 4,778,054 | 10/1988 | Newell et al. . | |
| 4,905,866 | 3/1990 | Bartell et al. . | |
| 4,909,395 | 3/1990 | Weissman . | |
| 4,998,623 | 3/1991 | Doull | 206/531 |
| 5,019,125 | 5/1991 | Rebne et al. . | |
| 5,109,984 | 5/1992 | Romick . | |
| 5,348,158 | 9/1994 | Honan et al. | 206/531 |

FOREIGN PATENT DOCUMENTS

| | | | |
|---|---|---|---|
| 0179743 | 4/1986 | United Kingdom | 206/531 |

*Primary Examiner*—John Sipos
*Assistant Examiner*—Ed Tolan
*Attorney, Agent, or Firm*—Kenneth P. Glynn

[57] ABSTRACT

The present invention is directed to a blister pack opener which includes a structure designed to receive a soft pack of individually segregated unit dosages of medication. The opener or soft pack puncturing mechanism has a first component, a second component and a third component which are hingedly connected to one another. The first component is a blister pusher and has a unit dosage section base protrusion thereon. The second component is a blister positioner and has an orifice located thereon which is of sufficient size to receive a unit dosage section of a soft pack commonly referred to as a "blister" and the third component is a blister cutter/ejector and has a cutting protrusion adapted to nest within the orifice of the second component and around the base protrusion of the first component so as to cut the packaging and eject the cut piece of the packaging along with the pill. Thus, the cutting protrusion has sufficient height so as to puncture a blister or dosage unit section of a soft pack medication. When a pack is placed within the first component so that dosage unit or "blister" is placed within the orifice of the second component, and then the second component and third component are hingedly pushed downwardly, the cutting protrusion on the third component will puncture the foil or flat element of the blister pack. Preferably, the cutting protrusion has toothed edges on this protrusion to enhance puncturing.

14 Claims, 3 Drawing Sheets

BLISTER PACK OPENER-EJECTOR

REFERENCE TO RELATED APPLICATION

This application is a continuation-in-part of U.S. patent application Ser. No. 08/047,994, filed on Apr. 19, 1993, by the same inventor herein, entitled "Blister Pack Opener", which is a continuation-in-part of U.S. patent application Ser. No. 08/006,528, filed on Jan. 21, 1993, by the same inventor herein, entitled "Container With Blister Pack Opener", now U.S. Pat. No. 5,356,010.

BACKGROUND OF THE INVENTION

1. Field of the Invention

The present invention is directed to soft-pack medication accessing, and more particularly, is directed to an opening which enables a user to open a blister component of a soft pack of medication. By soft pack is meant a plastic and/or foil or other "push the pill or capsule out" type of medication inner package commonly known as "blister packs". Thus, the present invention is directed to an opener for soft packs of medication with individual dosage opening capabilities. The present invention is directed to a blister pack opener-ejector device and more particularly a three component device having a first component which is a blister pusher, a second component which is a blister positioner and a third component which is a blister cutter/pill ejector. The components may be unistructurally formed with living hinges or may be individually molded components which are snapped or otherwise fitted together.

2. Information Disclosure Statement

Various inner packaging of medications have evolved over the past couple of decades which involves individual dosages arranged so as to be separated from one another within a blister pack, a paperpack, a metal/foil pack or a pack which uses a combination of materials. These may enclose powder, pills, capsules or even liquid caps or other medication dosage collections. Thus, while the application herein refers to "soft packs" or "blister packs" such terms should be read herein so as to include any type of packaging which has more than a flat shape for enclosure of individual medication dosages for easy, push out usage.

As these various forms of packaging evolved, some by mere design were difficult to open and others were intentionally made more difficult to open in order to prevent or discourage small children from easily pushing pills out of the blister packs. These packs sometimes became very difficult for the average person to open and even discouraged the purchase of over-the-counter medications packaged in this manner. Further, even those that were relatively easy for the average adult to open, were difficult for handicapped, senior citizens and people with arthritis and other hand impediments. As a result, some developments in the past decade have led to packaging with dispensing capabilities.

Thus, U.S. Pat. No. 3,993,190 to Heinz Schmidgall discloses a method and apparatus for packaging and dispensing stain removing agents in small, individualized capsules. The stain removing agents are preferably in paste form. The individual capsules are readily deformable and are stored in individual troughs in a receiving plate which, in turn, is covered by a covering sheet.

U.S. Pat. No. 4,015,717 to James E. Richardson describes a tablet package for use in chronologically dispensing tablets which includes a sheet of material having pockets therein for receiving tablets, a frangible closure layer secured to the sheet of material to enclose the tablets and a plurality of time related indicia disposed on the closure layer associated with each tablet and aligned with the pockets such that dispensing of a tablet ruptures the closure layer to obliterate the indicia associated with that tablet.

U.S. Pat. No. 4,159,568 issued to Howard E. Berner involves a container for capsules and the like having a cutter associated with the container for cutting the capsules. Hinged upper and lower portions of the container have cutting members secured thereto. Closure of the container portions effects cutting of a capsule inserted between the cutting members. In the preferred embodiments, the cutting members comprise a trough-shaped notch in the front wall of one of the container portions and a blade secured to the front wall of the other of the container portions, the blade and notch being superposed. An internal compartment is provided to receive a cut portion of a capsule.

U.S. Pat. No. 4,179,806 to Nathan S. Lieptz describes a pill-splitting implement or tool having self-centering means for positioning a pill in desired alignment with the path of movement of a pill-engaging projection in the form of a blade, wedge or edge. The projection is movably associated with the pill-holding structure, which preferably retains the pill in an elevated position above a support base to provide a clearance space or area underlying the pill to enhance clean, sharp splitting of the pill. The pill holding means is preferably of a resilient character to accommodate and yield to the displacement of the pill during the splitting or dividing operation.

U.S. Pat. No. 4,384,649 issued to Louis Brodsky and assigned to E.R. Squibb and Sons, Inc. describes a dispensing package which includes a blister pack and cover with an outer shell wherein the blister pack has multiple pockets for receiving medications and the outer shell has means for sealing the cover around each pocket of the blister pack. In one embodiment the outer shell has a rim which includes studs which align with the blister pack which includes cut-outs so that when it is closed, it affords easier removal of individual medication by the user.

U.S. Pat. No. 4,457,427 to Thomas A. Cafiero discloses card-type packages for holding and displaying flexible capsules and the like, and more particularly to a card having a puncturing means for opening the capsules.

U.S. Pat. No. 4,778,054, issued to Robert E. Newell and Robert A. Fitzsimmons and assigned to Glaxo Group Limited, describes a package for administering medicine to patients which includes a circular carrier disk which has a puncture means for removing individual medication dosages from circular blister packs.

U.S. Pat. No. 4,905,866 to Ralph Bartell et al. involves a device for holding and dispensing pills in a successive order. Pills are mounted in a compact in a single row in the desired successive order and a pill ejector is arranged for incremental movement in one direction along the compact. When the pill ejector is adjacent to a pill, a bendable member is displaced to push the pill out of a blister type package and through an opening in the rear of the compact.

U.S. Pat. No. 5,019,125, issued to Thomas M. Rebne and David Esslinger and assigned to Marion Marrell Dow, Inc. describes a dispensing container which includes means for pushing individual pills or groups of pills from a blister pack within the dispensing container. The method involves removal of individual dosages from the container without removing the blister pack from the container. While this system relies upon puncturing the blister pack and pushing the pills out, there is no child resistant aspect to it as shown in the present invention. In other words, a user does not remove a blister pack and strategically place it within a puncture mechanism as in the present invention in order to remove medication from the blister pack.

U.S. Pat. No. 5,109,984 issued on May 5, 1992 to Jarome M. Romick, describes a unit dosage medication handling and dispensing system. These devices receive blister packs and hold them in place and present open bottoms so that medications may be pushed through the blister pack bottom and through the openings in the bottom of the device.

Notwithstanding the stated prior art, it is believed that the present invention is neither taught nor rendered obvious as the present invention specifically accomplishes the dual purpose of enabling a user to more easily puncture and remove medication from a blister pack while making it difficult for a child to do so by having an unattached and therefore remote puncturing mechanism which requires a blister pack to be removed from the container and properly inserted into the opener and then further requires proper usage of the opener device itself for puncture of the blister pack and subsequent removal of the medication.

SUMMARY OF THE INVENTION

The present invention is directed to a blister pack opener which includes a structure designed to receive a soft pack of individually segregated unit dosages of medication. The opener or soft pack puncturing mechanism has a first component, a second component and a third component which are hingedly connected to one another. The first component is a blister pusher and has a unit dosage section base protrusion thereon. The second component is a blister positioner and has an orifice located thereon which is of sufficient size to receive a unit dosage section of a soft pack commonly referred to as a "blister" and the third component is a blister cutter/ejector and has a cutting protrusion adapted to nest within the orifice of the second component and around the base protrusion of the first component so as to cut the packaging and eject the cut piece of the packaging along with the pill. Thus, the cutting protrusion has sufficient height so as to puncture a blister or dosage unit section of a soft pack medication. When a pack is placed within the first component so that dosage unit or "blister" is placed within the orifice of the second component, and then the second component and third component are hingedly pushed downwardly, the cutting protrusion on the third component will puncture the foil or flat element of the blister pack. Preferably, the cutting protrusion has toothed edges on this protrusion to enhance puncturing.

BRIEF DESCRIPTION OF THE DRAWINGS

The present invention is more fully understood when the specification herein is taken in conjunction with the drawings appended hereto, wherein.

DETAILED DESCRIPTION OF THE INVENTION

The present invention is generally directed to individually segregated dosages of medication contained in soft packs. As mentioned in the Information Disclosure Statement above, soft packs include plasticpacks, paperpacks, metal/foil packs or packs using a combination of materials which enclose powder, pills, capsules or even liquid capsules or other medication or medicine related dosages or dosages of non-medicine related material in the form of individual units which are segregated from one another. One such soft pack is commonly referred to as a blister pack, and soft pack as used herein should be taken to mean blister packs but not solely limited to blister packs. The critical features of soft packs as used herein are that they individually segregate unit dosages of material, and that they are designed so that the user will push the unit dosage out or at least open a unit dosage containment by pushing and therefore bursting or puncturing the soft pack backing.

Thus, the present invention is directed to a device for opening units of material contained in a soft pack of individually segregated unit dosages of material such as medication.

The opener device of the present invention has three separate, hinged components. A first component, which is a blister pusher, a second component, which is a blister positioner, and a third component, which is a blister cutter/pill ejector. The first component has a push-out protrusion. The second component is designed with a cut-out orifice which is sized to receive at least a unit dosage portion of a soft pack. The third component, a cutter/ejector has a puncturing mechanism which is of sufficient size to puncture a unit dosage and is properly located so as to nest within the orifice of the second component and over the pusher device of the first component.

Figure 1:
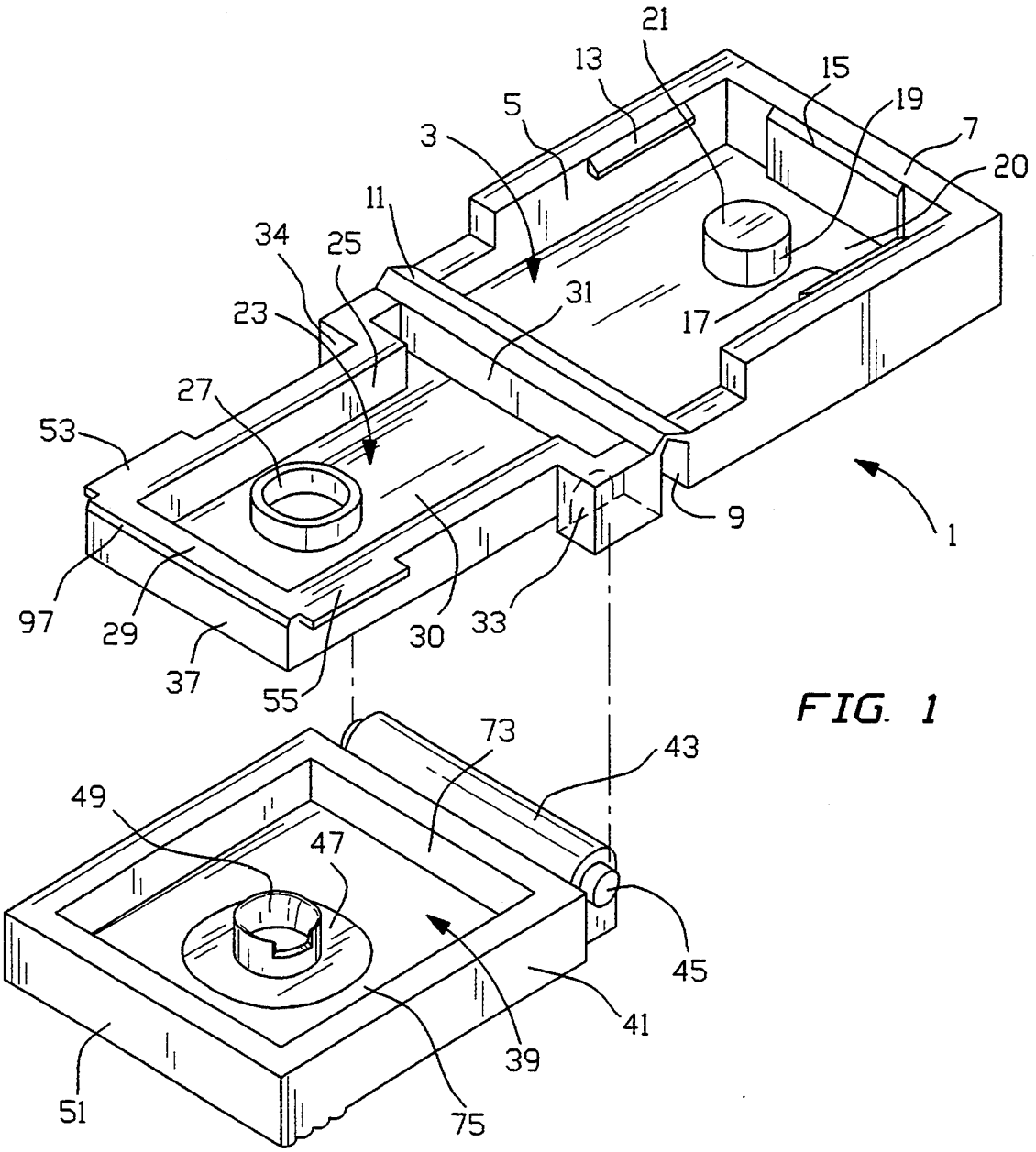
FIG. 1 shows an oblique view of a present invention device with the blister pusher component right side up and the second component blister positioner and the third component blister cutter/pill ejector in the open, upside down position.
Figure 2:
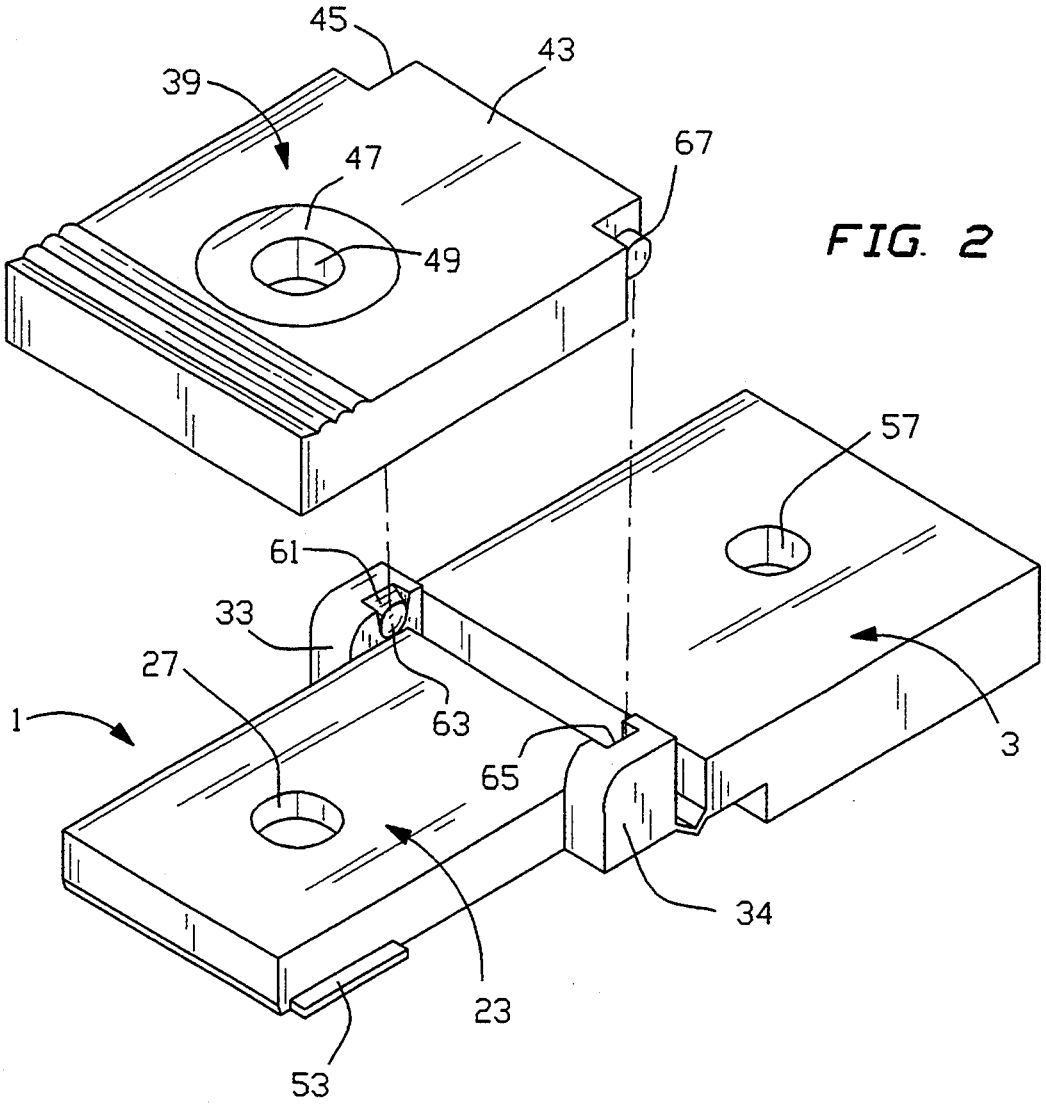
FIG. 2 shows the same device as FIG. 1 but with the same three components being shown in an reverse perspective view.
Figure 3:
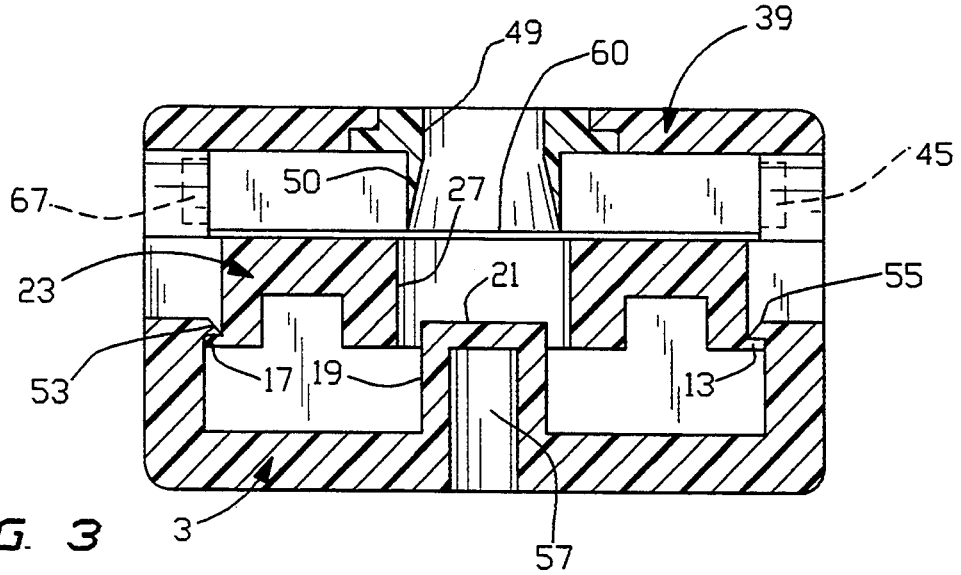
FIG. 3 shows a cut end view of a device such as is shown in FIGS. 1 and 2.
Figure 4:
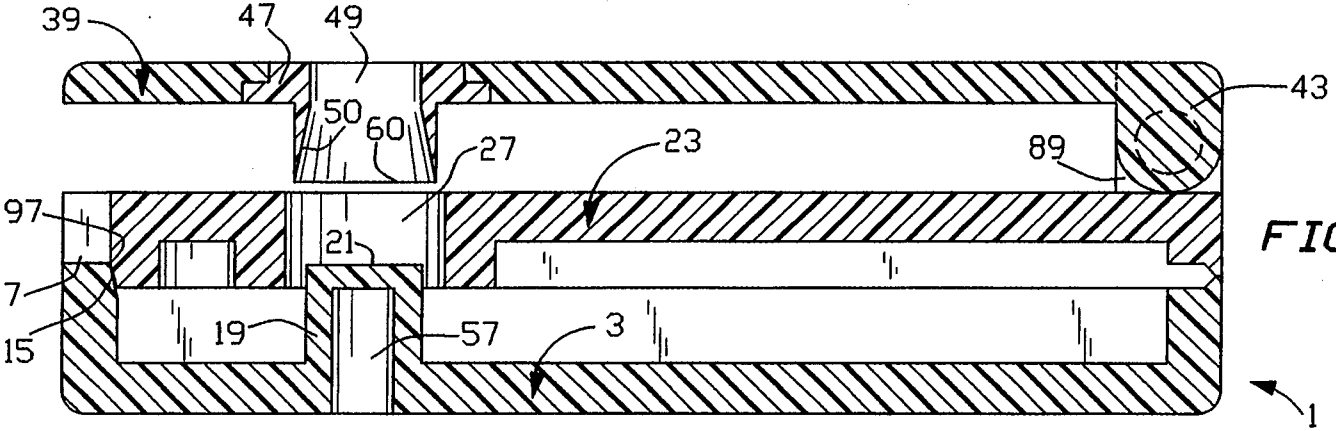
FIG. 4 shows a side cut view of the device shown in FIGS. 1 through 3; and, FIG. 5 shows a side cut partial view of a present invention opener in actual use, showing the puncturing of a blister pack unit dosage.

Referring now to FIGS. 1, 2, 3 and 4 there is shown in FIG. 1, the blister pusher component right side up and the second component blister positioner and the third component blister cutter/pill ejector in the open, upside down position, in FIG. 2, the same three components are shown in a reverse perspective view, in FIG. 3, a cut end view of a device such as is shown in FIGS. 1 and 2, and in FIG. 4, a side cut view of the device shown in FIGS. 1 through 3. Referring to all of these figures, present invention soft pack opener device 1 includes a first component 3 with side walls such as side wall 5, front wall 7 and back wall 9. There is a living hinge 11 connecting first component 3 to second component 23. First component 3 includes snap-fit ledges 13 and 17, as well as tapered edge 15. First component 3 acts as a blister pusher and at its bottom 20, has a blister base protrusion 19 with flat top surface 21 and molding recess 57.

Second component 23 includes side walls such as side wall 25, front wall 37 and back wall 31 which is connected to living hinge 11. On the outside of the side walls such as side wall 25 are protrusions 53 and 55 which interact with ledges 13 and 17 (shown interconnected in FIG. 3). Second component 23 acts as a blister positioner and has a guide orifice 27 through its bottom 30. Guide orifice 27 is of sufficient size and height so as to fit over base protrusion 19 and this is illustrated in FIGS. 3 and 4. Second component 23 has two extensions, extension 33 and extension 34 for receiving and interconnecting with a third component 39 in a hinged fashion. Extensions 33 and 34 include tracts 61 and 65 and recesses such as recess 63 for receiving hinged pegs 45 and 67 of third component 39. Additionally, second component 23 has a flat surface 29 and a tapered surface 97 which interact to create a spring-like action to push upwardly on second component 23 relative to first component 3 so as to securely fit ledges 13 and 17 with protrusions 55 and 53.

Third component 39 includes side walls such as side wall 41, front wall 51 and back wall 73. Bottom 75 includes a puncture mechanism 47 which includes protrusion 49 which has a predetermined height and cross-sectional opening so as to fit into guide orifice 27 and over base protrusion 19. Puncture mechanism protrusion 49 includes a tapered wall 50 with a cutting edge 60 as shown in FIGS. 3 and 4. Third component 39 has a hinge member 43 with pegs 45 and 67 which snap into extensions 33 and 34 discussed above. Thus, first component 3, second component 23 and third component 39 are hingedly connected with one another so that base protrusion 19, guide orifice 27 and puncture mechanism protrusion 49 may be in an open position and separate from one another or by hingedly rotating the three components toward one another, in a closed, puncture, eject position.

While both a living hinge Connection and a peg hinge connection are shown in the figures, the exact hinging mechanism is a matter of choice and may be any such mechanism available to the artisan.

Figure 5:
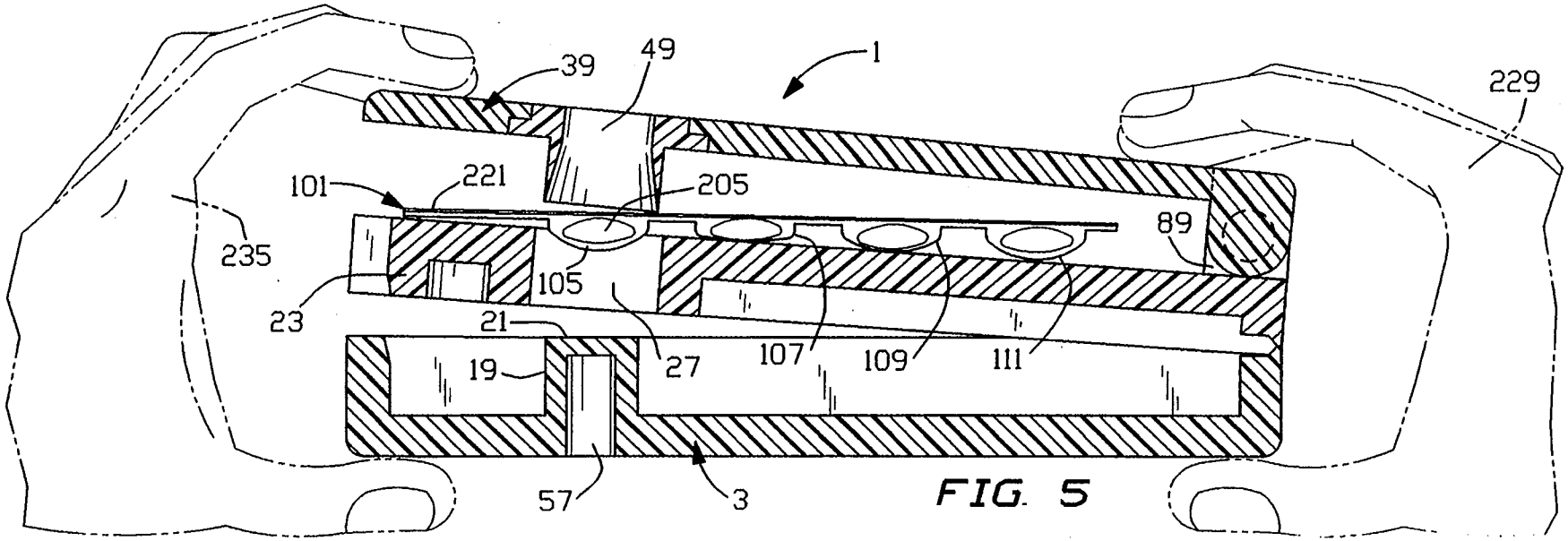

Referring to FIG. 5, there is a side view of device 1 shown in the previous figures which is shown in operation. Specifically, soft pack 101 with blisters 105, 107, 109 and 111 and with foil back 221 is shown inserted into soft pack opener 1 in a face down position so that foil back 221 faces upwardly. In this particular illustration, blister 105 is located in guide orifice 27 of second component 23 above flat top surface 21 and contains pill 205. As hands 229 and 235 hold and squeeze device 1, blister 105 with pill 205 then is pierced by puncture mechanism protrusion 49 through foil back 221, and continued downward pressure will eject pill 205 from soft pack 101. The user may then simply hold device 1 in his or her hand and tilt the device 1 so that the pill falls into the other hand for consumption.

The present invention device may be made of plastic or metal or a combination of construction materials. In one preferred embodiment, the device is made of molded plastic, except that puncture mechanism protrusion may be made of metal for extra structural support and extended cutability life.

Obviously, numerous modifications and variations of the present invention are possible in light of the above teachings. It is, therefore, understood that within the scope of appended claims, the invention may be practiced otherwise than as specifically described herein.

What is claimed is:

1. A soft pack opener, which comprises:

(a) a first component, being a blister pusher, and having a bottom and a blister base protrusion on said bottom of a respective size to receive a corresponding dosage unit section of a soft pack;

(b) a second component being hingedly connected to said first component, said second component being a blister positioner and having a guide orifice therethrough of sufficient size and height so as to fit over said base protrusion of said first component; and, (c) a third component, being a cutter/ejector, said third component having a puncture mechanism, said puncture mechanism having a puncture mechanism protrusion of a predetermined size and shape selected so as to nest within said guide orifice of said second component, the puncture mechanism protrusion having a predetermined height and a cross-sectional opening, both relating to the dimensions of a dosage unit of a soft pack backing, the predetermined height and cross-sectional opening being selected so as to puncture said dosage unit of a soft pack backing and so as to retain space between the puncture mechanism protrusion and the dosage unit when said dosage unit section is placed within upon said base protrusion of said first component and in said guide orifice of said second component while said second component and said third component are hingedly pushed downwardly toward said first component, said third component being hingedly connected to at least one of said first component and said second component.

2. The opener of claim 1 wherein the puncturing mechanism protrusion has a predetermined strength, the predetermined strength being greater than the strength of the soft pack backing, the predetermined strength selected to puncture a dosage unit section of the soft pack backing of the soft pack.

3. The opener of claim 1 wherein the puncturing mechanism protrusion is a thin, tapered protrusion.

4. The opener of claim 3 wherein the puncturing mechanism protrusion has a cutting edge.

5. The opener of claim 1 wherein said puncturing mechanism protrusion is a thin, tapered member formed of a plastic material.

6. The opener of claim 1 wherein said first component and said second component are in the form of a unistructural member and are hingedly connected to one another by a living hinge.

7. The opener of claim 1 wherein said third component is hingedly connected to said second component at one end being a hingeable portion, said puncturing mechanism protrusion being located near the opposite end of the hingeable portion.

8. The opener of claim 7 wherein said puncturing mechanism protrusion is a thin, tapered member formed of a plastic material.

9. The opener of claim 1 wherein said first component and said second component have interacting ledges and protrusions to hold them together in a closed position.

10. The opener of claim 9 wherein said first component and said second component are constructed so as to create a spring bias relative to one another when in said closed position.

11. The opener of claim 1 wherein said first and second components have side walls of predetermined dimensions so as to allow said second component to at least partially rest within said first component.

12. The opener of claim 2 wherein said first and second components have side walls of predetermined dimensions so as to allow said second component to at least partially rest within said first component.

13. The opener of claim 6 wherein said first and second components have side walls of predetermined dimensions so as to allow said second component to at least partially rest within said first component.

14. The opener of claim 7 wherein said first and second components have side walls of predetermined dimensions so as to allow said second component to at least partially rest within said first component.

* * * * *